US005104297A

United States Patent [19]

Sekiguchi et al.

[11] Patent Number: 5,104,297

[45] Date of Patent: Apr. 14, 1992

[54] ROTARY COMPRESSOR HAVING AN ECCENTRIC PIN WITH REDUCED AXIAL DIMENSION

[75] Inventors: Koichi Sekiguchi; Yukio Serizawa, both of Tochigi, Japan

[73] Assignee: Hitachi, Ltd., Tokyo, Japan

[21] Appl. No.: 621,896

[22] Filed: Dec. 4, 1990

[30] Foreign Application Priority Data

Dec. 6, 1989 [JP] Japan ..... 1-315217

[51] Int. Cl.[5] ..... F04B 35/00; F04C 17/02

[52] U.S. Cl. ..... 417/410; 418/63

[58] Field of Search ..... 418/63; 417/410

[56] References Cited

U.S. PATENT DOCUMENTS 1,543,163 6/1925 Johnson et al. ..... 418/63
1,983,997 12/1934 Rolaff ..... 418/63
2,153,371 4/1939 Hubacker ..... 418/63
4,730,996 3/1988 Akatsuchi et al. ..... 418/63
4,881,879 11/1989 Oritz ..... 418/63

FOREIGN PATENT DOCUMENTS 2429456 1/1976 Fed. Rep. of Germany ..... 418/63
59-201994 11/1984 Japan ..... 418/63
60-1385 1/1985 Japan .

*Primary Examiner*—Richard A. Bertsch
*Assistant Examiner*—David L. Cavanaugh
*Attorney, Agent, or Firm*—Antonelli, Terry, Stout & Kraus

[57] ABSTRACT

A rotary compressor has an electric motor and a compression mechanism drivingly connected thereto by a crank shaft including an eccentric portion having flangelike thrust bearing sections and an eccentric pin section on which a rolling piston is mounted for eccentric rotation in a cylinder bore. The eccentric pin section has formed therein at least one axial through-hole for reducing the mass unbalance of the pin section. The crank shaft has formed thereon coaxial sections each concentric to the axis of rotation of the crank shaft and disposed between the eccentric pin section and one of the thrust bearing sections to decrease the axial dimensions thereof and of the eccentric pin section for thereby decreasing the total mass unbalance of the eccentric portion of the crank shaft whereby crank shaft deflection due to mass unbalance is remarkably reduced particularly at a high speed operation.

4 Claims, 8 Drawing Sheets

ROTARY COMPRESSOR HAVING AN ECCENTRIC PIN WITH REDUCED AXIAL DIMENSION

FIELD OF THE INVENTION

The present invention relates to a rotary compressor which can be used mainly in air conditioner and, more particularly, to a rotary compressor having improved performance as well as improved reliability at high speed operation.

DESCRIPTION OF THE RELATED ART

The known rotary compressors will be described with reference to FIGS. 6 to 10.

Figure 6:
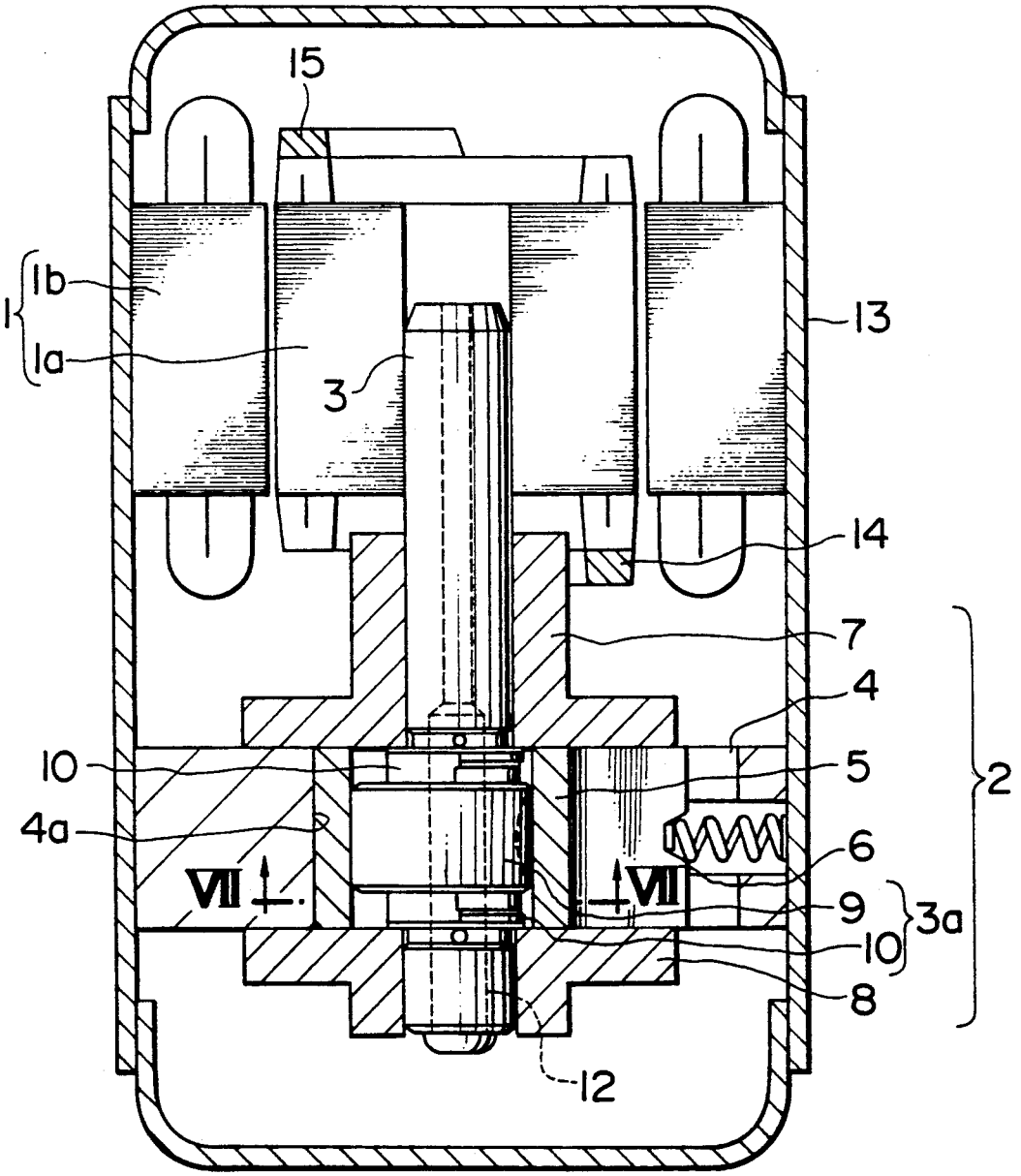
FIG. 6 PRIOR ART
FIG. 6 is a vertical sectional view of a known rotary compressor.

Referring to FIG. 6, the known rotary compressor has an electric motor 1 including a rotor 1*a* and a stator 1*b*, a compression mechanism 2, a crank shaft 3 through which the compression mechanism 2 is drivingly connected to the electric motor 1, and a substantially closed container 13 accommodating the electric motor 1, the compression mechanism 2 and the crank shaft 3.

The compression mechanism 2 has a cylinder block 4 fixed to the inner surface of the container 13 and having a cylinder bore 4*a* formed therein, a rolling piston 5 rotatably carried by an eccentric portion 3*a* of the crank shaft positioned in the cylinder bore 4*a*, a vane 6 reciprocally movable in accordance with revolution of the rolling piston 5, and main and sub-bearings 7 and 8 which hermetically close the upper and lower ends of the cylinder bore 4*a* and rotatably support the crank shaft 3.

The eccentric portion 3*a* of the crank shaft 3 has a pin portion 9 which slidingly engages with the rolling piston 5, and thrust portions 10 connected to both ends of the pin portion 9 and slidingly engaging with the main and sub-bearings 7 and 8.

The crank shaft 3 has an axial bore 12 serving as a lubricating oil passage through which a lubricating oil is supplied to the main bearing 7, the sub-bearing 8 and also to the clearance between the rolling piston 5 and the crank shaft 3.

Figure 7:
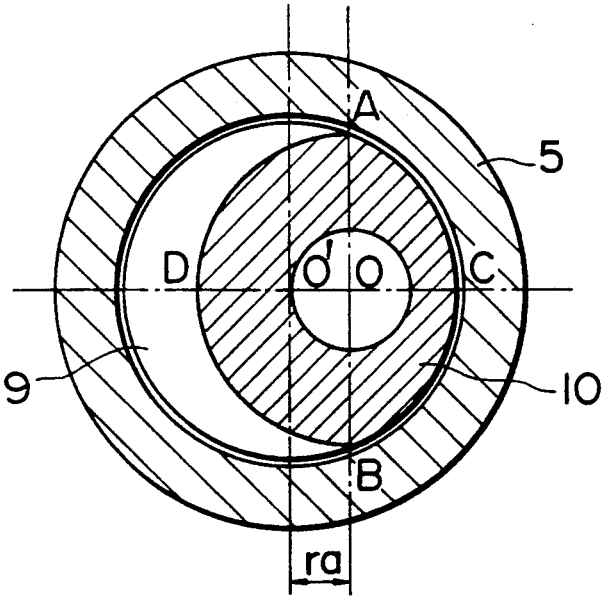
FIG. 7 PRIOR ART
FIG. 7 is a cross-sectional view taken along the line VII—VII in FIG. 6.

As will be seen from FIG. 7, the axis O' of the pin portion 9 is offset by a distance or dimension ra from the axis 0 of the crank shaft 3, so that an unbalance of moment expressed by (ma·ra) is generated as a result of the eccentricity ra, where ma represents the mass of the pin portion.

Each thrust portion 10 has a configuration which is defined by an arc ACB centered to the axis O' of the pin portion 9 and an arc ADB centered to the axis O of the crank shaft 3. An unbalance of moment also exists on the thrust portion 10 due to the offset of the axes of the two arcs determining the configuration of the thrust portion 10.

Thus, the eccentric portion 3*a*, due to its geometry, produces a synthetic unbalance MR which is the sum of the unbalance (ma·ra) of the pin portion 9 and the unbalance of the thrust portions 10.

Furthermore, an additional unbalance represented by (mr·ra, where mr represents the mass of the rolling piston) is applied to the pin portion 9 because the rolling piston 5 revolves within the cylinder about the axis 0 with the same amount of eccentricity ra as the pin portion 9. Consequently, a centrifugal force expressed by $\{(MR+mr\cdot ra)\omega^2\}$ acts on the eccentric portion 3*a* when the crank shaft 3 rotates at an angular velocity $\omega$.

In order to negate or cancel the unbalanced force caused by the rotation of the eccentric portion 3*a* of the crank shaft 3 and the eccentric rotation of the rolling piston 5, a first balancer 14 and a second balancer 15 are attached, respectively, to the lower end and the upper end of the rotor la which is connected to the end of the crank shaft 3 adjacent the main bearing 7.

Figure 8:
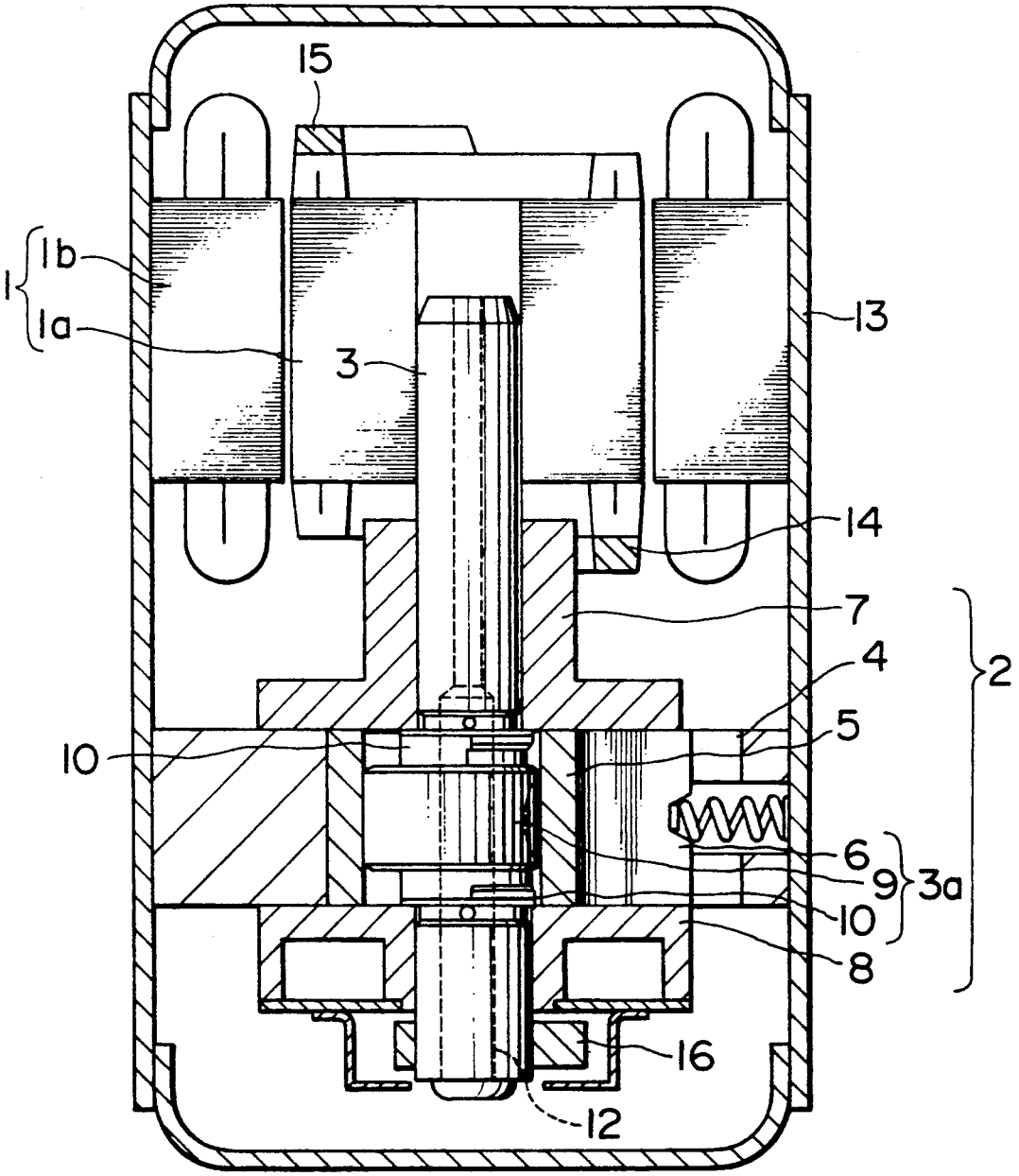
FIG. 8 PRIOR ART
FIG. 8 is a vertical sectional view of another known rotary compressor.

A rotary compressor is also known in which, as shown in FIG. 8, a third balancer 16 is fixed to the end the crank shaft 3 adjacent the sub-bearing 7 in addition to the first and second balancers 14 and 15.

Figure 9:
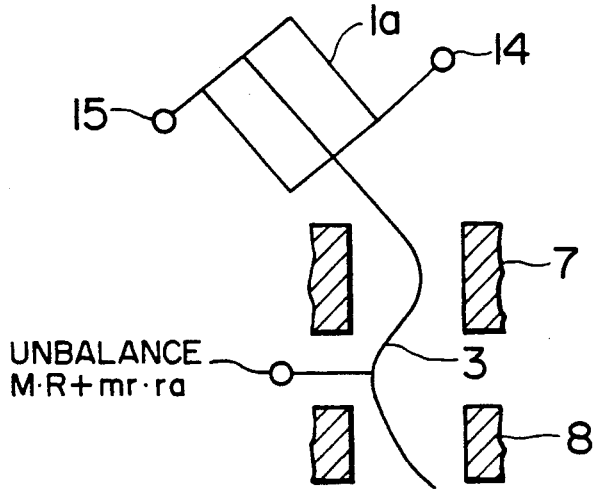
FIG. 9 PRIOR ART
FIG. 9 is an illustration of the mode of deflection of a crank shaft in the known rotary compressor shown in FIG. 6.
Figure 10:
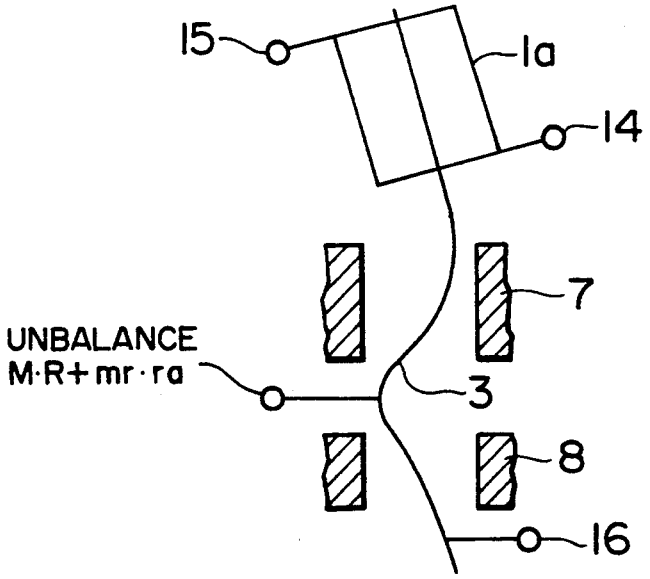
FIG. 10 is an illustration of the mode of deflection of a crank shaft in the known rotary compressor shown in FIG. 8.

FIG. 9 shows the mode of deflection of the crank shaft in the known rotary compressor of FIG. 6 which is devoid of the third balancer 16, while FIG. 10 illustrates the mode of deflection of the crank shaft in the known rotary compressor having the third balancer 16. In both cases, the crank shaft 3 deflects in the main and subbearings 7 and 8 to make uneven contacts at the upper and lower ends of the bores in these bearings 7 and 8.

A known rotary compressor of the kind described is disclosed, for example, in Japanese Patent Unexamined Publication No. 60-1385.

In operation of these known rotary compressors, the shaft deflects due to centrifugal forces caused by the eccentric rotations of the eccentric portion of the crank shaft and of the rolling piston and due to the balances. The level of the centrifugal force increases in proportion to the square of the angular velocity $\omega$ of the crank shaft. Consequently, a large unbalanced force and, hence, a large amount of deflection are caused on the crank shaft particularly when the rotation speed of the compressor is high, resulting in a seriously heavy uneven contacts at the upper and lower edges of the bearings. The heavy uneven contacts tend to cause sticking between the crank shaft and the bearings, thus impeding the reliability of operation of the compressor. The uneven contact also increases the loss of power due to friction, thus requiring and consuming a greater power.

SUMMARY OF THE INVENTION

Accordingly, an object of the present invention is to provide a rotary compressor which can remarkably reduce the unbalanced force acting on the eccentric portion of the crank shaft so as to reduce uneven contacts at the upper and lower ends of the bearing bores of the main and sub-bearings, thereby improving reliability of the compressor at high-speed operation while reducing the power to be input to the compressor.

To this end, according to one aspect of the preset invention, there is provided a rotary compressor comprising: an electric motor; a cylinder block having a cylinder bore formed therein; a crank shaft adapted to be driven by the electric motor about a first axis and including a pin section disposed in the cylinder bore and having a second axis; a pair of axially spaced bearing members rotatably supporting the crank shaft and disposed to close both ends of the cylinder bore; and a rolling piston disposed in the cylinder bore and rotatably carried by the pin section so as to revolve about the first axis in accordance with the rotation of the crank shaft; wherein at least one through-hole is formed in the pin section so as to reduce the amount of unbalance of the pin section with respect to the first axis.

According to another aspect of the present invention, there is provided a rotary compressor comprising: a substantially closed container accommodating an electric motor and a compression mechanism drivingly connected thereto by a crank shaft; the crank shaft including an end portion having a first axis and fixed to a rotor of the motor and an eccentric portion drivingly connected to the compression mechanism; the compression mechanism including a cylinder block having formed therein a cylinder bore accommodating the eccentric portion of the crank shaft, a rolling piston disposed in the cylinder bore and rotatably mounted on the eccentric portion of the crank shaft so that the rolling piston can be revolved in the cylinder bore by eccentric rotation of the eccentric portion of the crank shaft about the first axis, a vane reciprocally movable following revolutions of the rolling piston, and first and second bearing members closing the opposite ends of the cylinder bore and rotatably supporting the crank shaft; and balancer means for cancelling an unbalanced force generated by eccentric rotation of the eccentric portion of the crank shaft and the rolling piston, wherein: the eccentric portion of the crank shaft includes a pin section having a second axis eccentric to the first axis and disposed in slidable engagement with an inner peripheral surface of the rolling piston; the pin section has an axial dimension less than that of the cylinder bore and is formed therein with at least one axial through-hole for reducing the amount of unbalance of the eccentric portion of the crank shaft with respect to the first axis; the eccentric portion of the crank shaft further includes a pair of thrust bearing means formed on the crank shaft and disposed in the cylinder bore in sliding contact with the axially opposed surfaces of the first and second bearing members, and coaxial sections each formed between the eccentric pin section and one of the thrust bearing means and in concentric relationship to the first axis.

In the rotary compressor of the one aspect of the invention, the unbalanced force acting on the eccentric portion of the crank shaft is reduced by the fact that the mass unbalance is reduced by virtue of the presence of at least one through-hole formed in the pin section of the eccentric portion of the crank shaft. Consequently, the deflection of the crank shaft during high-speed operation of the compressor is decreased to substantially eliminate or reduce the uneven contacts of the crank shaft with the bearing members which were inevitably caused in the known rotary compressors.

The rotary compressor of the other aspect of the invention provides, in addition to the feature of the one aspect, i.e., the provision of the through-hole, a feature that the eccentric portion of the crank shaft has the pin section, thrust bearing sections and coaxial sections each disposed between one of the thrust bearing sections and the pin section. Consequently, the axial dimension of the pin section, which is eccentric to the axis of rotation of the crank shaft, is remarkably decreased with respect to the axial dimension of the cylinder bore so that the rotational mass unbalance of the pin section is correspondingly decreased. Furthermore, the coaxial or non-eccentric portions provided between the pin section and the thrust bearing sections serve to reduce the axial dimensions of the thrust bearing sections which are generally eccentric with respect to the axis of rotation of the crank shaft. Consequently, the mass of the thrust bearing sections and, hence, unbalance of rotational mass thereof are reduced. Therefore, total mass of the eccentric portion, including the pin section, the coaxial sections and the thrust bearing sections, and total unbalanced force acting on the eccentric portion during operation of the rotary compressor are decreased as compared with those in the known rotary compressors of the kind described, whereby deflection of the crank shaft is appreciably reduced to offer a great advantage that the uneven contacts between the crank shaft and the bearing bores are remarkably reduced.

DESCRIPTION OF THE PREFERRED EMBODIMENTS

Preferred embodiments of the present invention will be described with reference to FIGS. 1 to 5.

Figure 1:
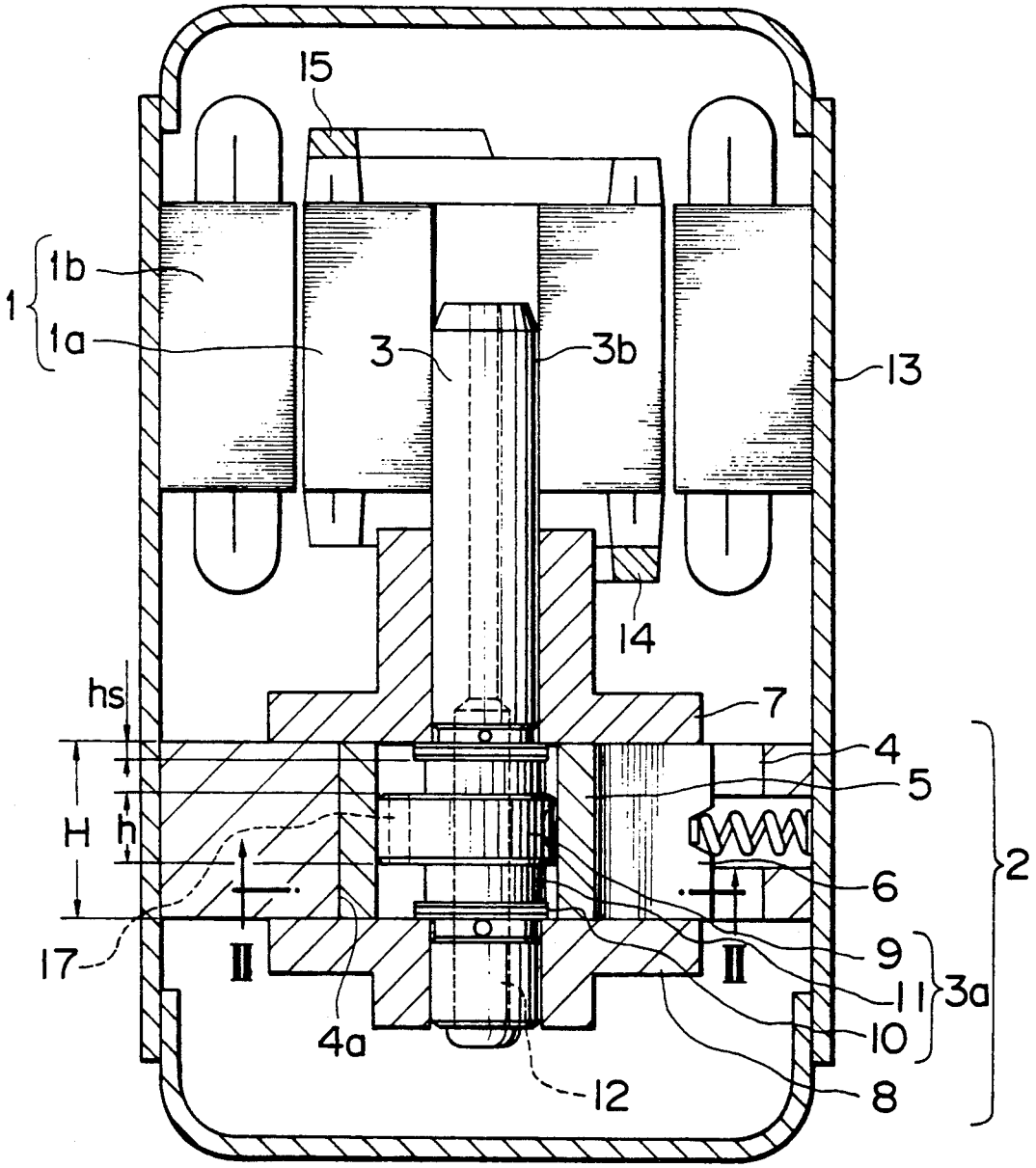
FIG. 1 is a vertical sectional view of an embodiment of the rotary compressor of the present invention.

Referring to FIG. 1, a rotary compressor embodying the present invention has an electric motor 1 including a rotor 1*a* and a stator 1*b*, a compression mechanism 2, a crank shaft 3 which is connected at its one end 3*b* to the rotor 1*a* of the electric motor 1, and a substantially closed container 13 which accommodates the electric motor 1, compression mechanism 2 and the crank shaft 3.

The compression mechanism 2 has a cylinder 4 fixed to the inner surface of the container 13 and having a cylinder bore 4*a* formed therein, a ring-shaped rolling piston 5 rotatably carried by an eccentric portion 3*a* of the crank shaft 3 located within the cylinder bore 4*a*, a vane 6 slidably supported by the rolling piston 5 so as to reciprocally move in accordance with the rotation of the rolling piston 5, and main and sub-bearings 7 and 8 which hermetically close the upper and lower ends of the cylinder bore 4*a* and rotatably supporting the crank shaft 3. Both axial end surfaces of the rolling piston 5, each having an annular form, are held in sliding contact with the axially opposing surfaces of the main and sub-bearings 7 and 8.

The eccentric portion 3*a* of the crank shaft 3 has a pin section 9 which slidingly contacts the inner surface of the rolling piston 5, flange-like thrust bearing sections 10 which slidingly engage with the main and sub-bearings 7 and 8, and coaxial sections 11 each disposed between one of the thrust bearing sections 10 and the pin section 9. Each coaxial section 11 has a diameter smaller than that of the thrust bearing section 10 and is coaxial with the axis of the crank shaft 3. The pin section 9 is disposed substantially at the axially mid portion of the rolling piston 5. The crank shaft 3 is provided at the center thereof with an axial bore serving as a lubricating oil passage bore 12 through which a lubricating oil is supplied to the bearing surfaces of the main and sub-bearings 7 and 8 and of the rolling piston 5.

The pin section 9 has an axial height h which is determined to be as small as possible. More specifically, the axial height h of the pin section 9 is set to a value which is minimum but is allowable from the view points of the thickness of the oil film formed between the pin section 9 and the rolling piston 5 as well as of the greatest inclination of the rolling piston which is possible to occur during operation of the compressor.

In the known rotary compressors of the kind described, the axial dimension h of the pin section of the rotary compressor is generally from 60 to 80% of the axial dimension H of the cylinder bore. In the described embodiment, however, the axial dimension h of the pin section 9 is 45%, but can be reduced to a range of from 35% to 60%, of the axial dimension H of the bore.

Figure 2:
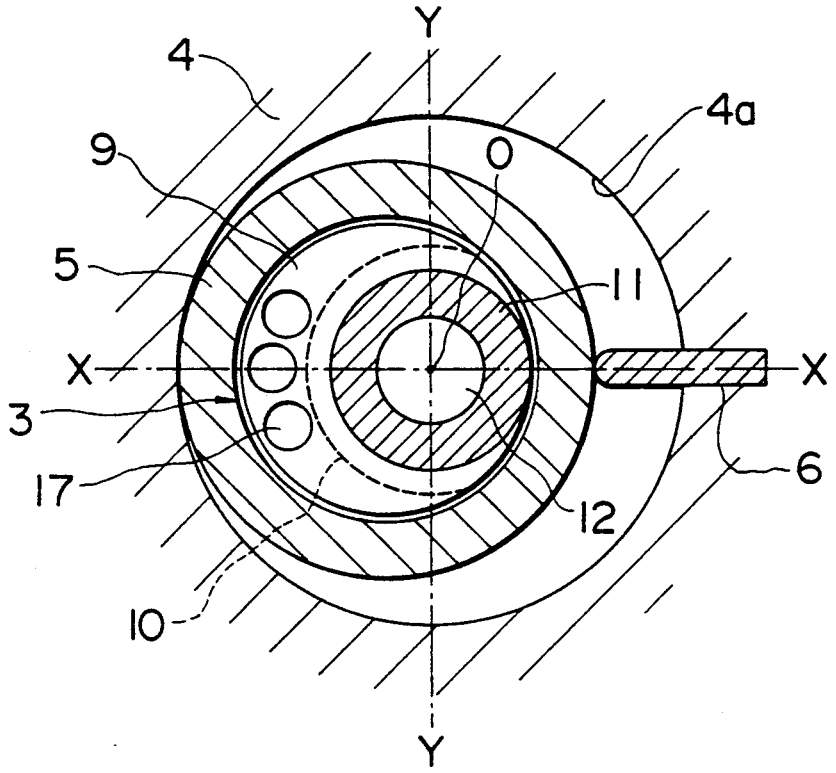
FIG. 2 is a cross-sectional view taken along the line II—II in FIG. 1.

As will be seen from FIG. 2, the pin section 9 has a plurality of axial through-holes 17 which are formed in the eccentric region of the pin section 9. In the illustrated embodiment, three such axial through-holes 17 are provided. Preferably, these axial through-holes 17 are located radially outwardly of the outer peripheral surfaces of the thrust bearings 10 and are spaced radially outwardly as much as possible from a Y-axis perpendicular to an X-axis which represents the direction of the eccentricity of the pin section 9 relative to the axis of the crank shaft 3. For instance, when the diameter of the pin section 9 is 26.3 mm, the diameter of each axial through-hole may preferably be 4.2 mm.

Referring again to FIG. 1, the axial dimension $h_s$ of each thrust bearing section 10, which slidingly contacts the main or sub-bearing 8, is determined to be the possible minimum dimension which is still large enough to enable the thrust bearing section 10 to withstand the maximum thrust load which will be generated during operation of the rotary compressor. In the illustrated embodiment, the ratio of the axial dimension $h_s$ of each thrust bearing section 10 to the axial dimension H of the cylinder bore 4*a* is about 9%. This ratio, however, can range between 5% and 10%. Accordingly, the axial dimension of each coaxial section 11 can range from 10% to 27.5% of the axial dimension H of the cylinder bore 4*a*.

Each coaxial section 11 between the pin section 9 and one of the thrust sections 10 has a circular crosssection which is concentric to the axis of the crank shaft 3. In consequence, both coaxial sections 11 do not cause any rotational mass unbalance.

By virtue of the structural features described above, the amount of the mass unbalance of the whole eccentric portion 3*a* of the crank shaft 3 is reduced to about 40% of that in known rotary compressors of the kind described. Moreover, the total mass unbalance, including the above-mentioned unbalance of the eccentric portion 3*a* and the unbalance caused by the eccentric rotation of the rolling piston 5, can be reduced to about 70% of that in the known rotary compressors.

Referring again to FIG. 1, a first balancer 14 and a second balancer 15, respectively, are attached to the upper and lower ends of the rotor 1*a* of the electric motor 1 in order to compensate for the rotational mass unbalance produced by the eccentric portion 3*a* of the crank shaft 3 and the rolling piston 5. In the illustrated embodiment, the masses and, hence, the dimensions of the balancers 14 and 15 can be reduced because the rotational mass unbalance caused by the eccentric portion 3*a* and the rolling piston 5 are remarkably reduced as described above.

Figure 3:
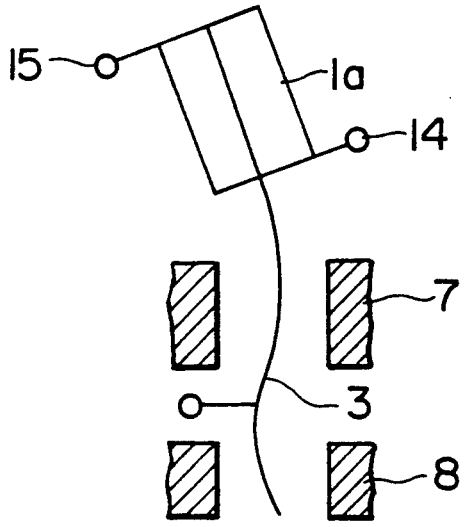
FIG. 3 is an illustration of the mode of deflection of a crank shaft incorporated in the rotary compressor shown in FIG. 1.

FIG. 3 illustrates the mode of the crank shaft deflection in the illustrated embodiment It will be seen that the amounts of deflection of the crank shaft are reduced both in the main and sub-bearings 7 and 8, thus reducing the uneven contact between the crank shaft 3 and the bearings 7 and 8, as compared with the crank shaft deflections of the known rotary compressors shown in FIG. 9.

Figure 4:
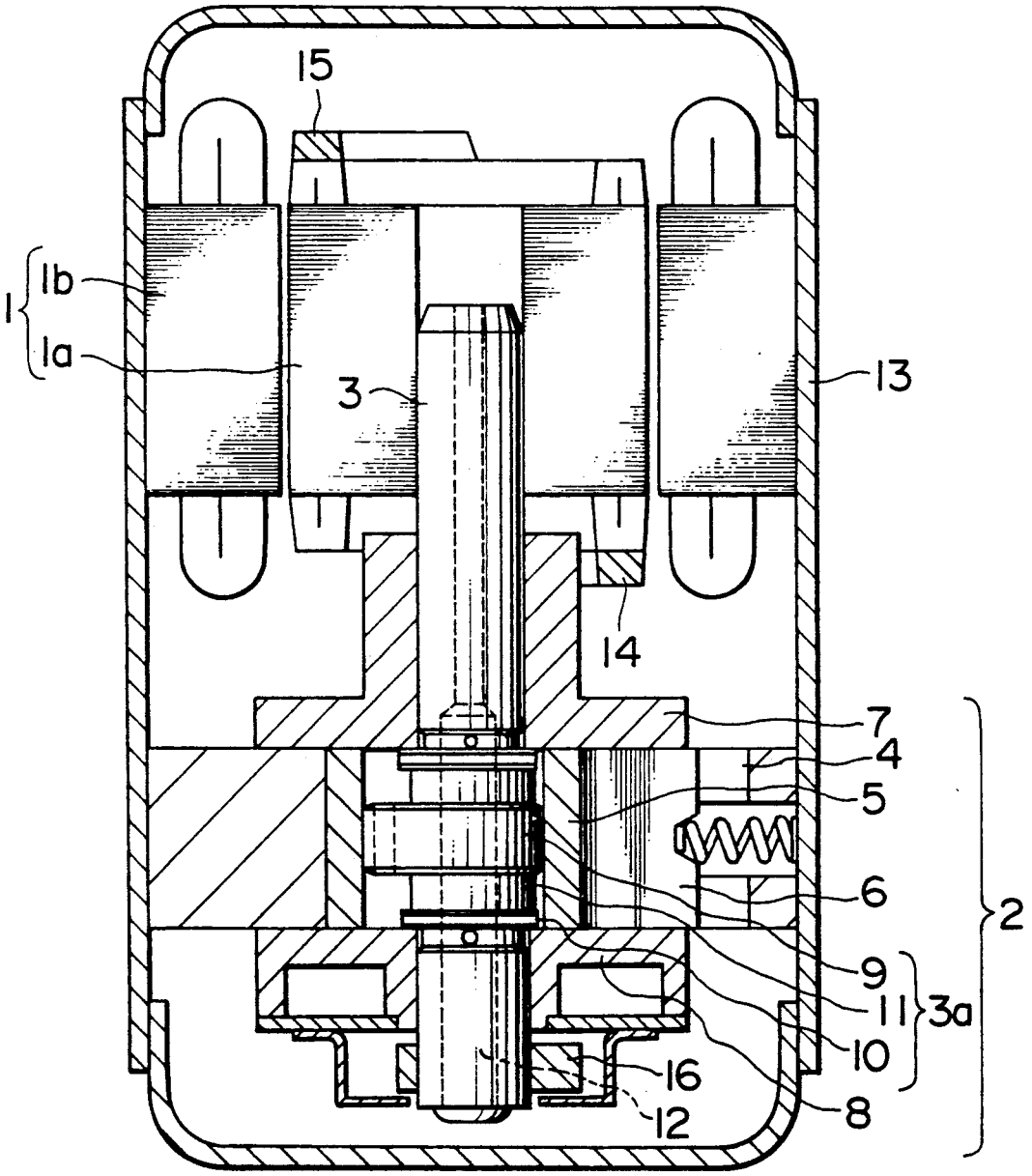
FIG. 4 is a vertical sectional view of another embodiment of the rotary compressor of the present invention.
Figure 5:
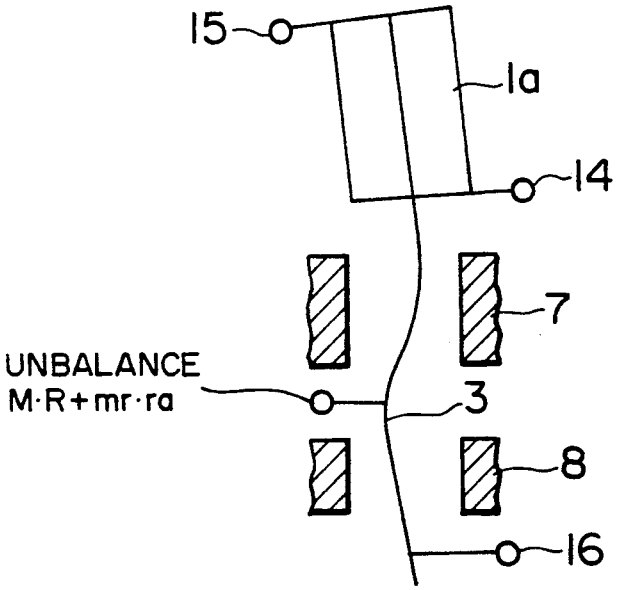
FIG. 5 is an illustration of the mode of deflection of a crank shaft in the rotary compressor shown in FIG. 4.

FIG. 4 shows another embodiment in which a third balancer 16 is attached to the end of the crank shaft 3 adjacent the sub-bearing 8, while FIG. 5 shows the mode of deflection of the crank shaft 3 in this embodiment. It will be seen that the amounts of deflection are reduced both in the main and sub-bearings 7 and 8, thus reducing the uneven contact between the crank shaft 3 and the bearings 7 and 8, as is the case of the first embodiment.

As will be understood from the foregoing description of the preferred embodiments, according to the present invention, uneven contact of the crank shaft with the bearings can be greatly reduced by virtue of the remarkable reduction in the rotational mass unbalance of the eccentric portion 3*a* of the crank shaft, thus suppressing tendencies of sticking between and local wears of the crank shaft and the bearings. Consequently, the reliability of operation of the compressor is remarkably improved particularly at high speed at which the crank shaft tends to be deflected largely. The reduced tendency of the uneven contact between the crank shaft and the bearings also reduces loss of power due to friction, so that the power to be input to the compressor can be decreased to provide a remarkable improvement in the performance of the compressor. It is also to be noted that the reduction in the loss of power caused by friction is attained also in the sliding engagement between the rolling piston 5 and the pin section of the crank shaft. In fact, the compressors of the described embodiments have attained about 1.5% reduction in the input power as compared with known rotary compressors of the kind described.

What is claimed is:

1. A rotary compressor comprising:

a substantially closed container accommodating an electric motor and a compression mechanism drivingly connected thereto by a crank shaft, said crank shaft including an end portion having a first axis and fixed to a rotor of said motor, and an eccentric portion drivingly connected to said compression mechanism;

said compression mechanism including a cylinder block having formed therein a cylinder board accommodating said eccentric portion, a rolling piston disposed in said cylinder bore and rotatably mounted on said eccentric portion so that said rolling piston is revolvable in said cylinder bore by eccentric rotation of said eccentric portion about said first axis, a vane reciprocally movable following revolutions of said rolling piston, and first and second bearing members closing opposite ends of said cylinder bore and rotatably support said crank shaft; and balancer means for cancelling an unbalanced force generated by eccentric rotation of said eccentric portion of said crank shaft and said rolling piston, wherein:

said eccentric portion of said crank shaft includes a pin section having a second axis eccentric to said first axis and disposed in slidable engagement with an inner peripheral surface of said rolling piston, said pin section has an axial dimension less than an axial dimension of said cylinder bore and is formed therein with at least one axial through-hole for reducing the amount of unbalance of said eccentric portion of said crank shaft with respect to said first axis, said eccentric portion of said crank shaft further includes a pair of thrust bearing means formed on said crank shaft and disposed in said cylinder in sliding contact with the axially opposed surfaces of said first and second bearing members, and coaxial sections each formed between said eccentric pin section and one of said thrust bearing means and in concentric relationship to said first axis, said thrust bearing means each comprise a flange-like section formed on said crank shaft and said concentric sections have diameters each smaller than a diameter of each of said flange-like thrust bearing sections, said eccentric pin section has an axial dimension ranging from 35% to 60% of the axial dimension of said cylinder bore, said coaxial sections each have an axial dimension ranging from 10% to 27.5% of the axial dimension of said cylinder bore, and wherein said flange-like thrust bearing sections each have an axial dimension ranging from 5% to 10% of said axial dimension of said cylinder bore.

2. A rotary compressor according to claim 1, wherein said pin section of said crank shaft is formed therein with a plurality of such axial through-holes and wherein said axial through-holes are disposed radially outwardly of the outer peripheral surfaces of said flange-like thrust bearing sections.

3. A rotary compressor comprising:

an electric motor;

a cylinder block having a cylinder bore formed therein;

a crank shaft adapted to be rotated by said motor about a fixed axis and including a pin section disposed in said cylinder bore and having a second axis eccentric to said first axis;

a pair of axially spaced bearing members rotatably supporting said crank shaft and disposed to close opposite ends of said cylinder bore;

a rolling piston disposed in said cylinder bore and rotatably mounted on said pin section so that said rolling piston can be revolved by said crank shaft about said first axis, wherein:

said pin section of said crank shaft is formed therein with at least one through-hole for reducing the amount of unbalance of said pin section with respect to said first axis, said crank shaft further includes a pair of flange-like thrust bearing sections disposed in said cylinder bore in sliding engagement with the axially opposed facing of said bearing members, respectively, and a pair of concentric sections each formed on said crank shaft between said pin section and one of said thrust bearing sections and having a circular cross-section concentric to said first axis, said eccentric pin section has an axial dimension ranging from 35% to 60% of the axial dimension of said cylinder bore, said coaxial sections each have an axial dimension ranging from 10% to 27.5% of the axial dimension of said cylinder bore, and wherein said flange-like thrust bearing sections each have an axial dimension ranging from 5% to 10% of said axial dimension of said cylinder bore.

4. A rotary compressor according to claim 3, wherein said concentric sections each have a diameter smaller than that of each of said flange-like thrust bearing sections.

* * * * *